United States Patent [19]

Omori et al.

[11] Patent Number: 4,714,622

[45] Date of Patent: Dec. 22, 1987

[54] BLAST MATERIAL FOR MECHANICAL PLATING AND CONTINUOUS MECHANICAL PLATING USING THE SAME

[75] Inventors: Shigeru Omori; Masatsugu Watanabe; Fumio Oboshi, all of Okayama, Japan

[73] Assignee: Dowa Iron Powder Co., Ltd., Okayama, Japan

[21] Appl. No.: 923,475

[22] Filed: Oct. 27, 1986

Related U.S. Application Data

[62] Division of Ser. No. 753,879, Jul. 11, 1985, Pat. No. 4,655,832.

[30] Foreign Application Priority Data

Jul. 30, 1984 [JP] Japan ..... 59-157341

[51] Int. Cl.[4] ..... B05D 1/12

[52] U.S. Cl. ..... 427/11; 72/47; 72/53; 427/191; 427/192

[58] Field of Search ..... 72/47, 53; 427/11, 191, 427/192, 427; 106/14.21

[56] References Cited

U.S. PATENT DOCUMENTS

| | | | |
|---|---|---|---|
| 2,149,253 | 3/1939 | Cooper | 427/11 |
| 2,618,572 | 11/1952 | Parrish | 427/11 |
| 2,640,002 | 5/1953 | Clayton | 427/192 X |
| 3,380,433 | 4/1968 | Gerlovich | 427/191 X |
| 3,754,976 | 8/1973 | Babecki et al. | 427/192 X |
| 3,765,923 | 10/1973 | Bender-Christensen | 427/205 |
| 4,524,111 | 6/1985 | Oka | 106/14.21 X |
| 4,552,784 | 11/1985 | Chu et al. | 72/53 X |

FOREIGN PATENT DOCUMENTS

| | | |
|---|---|---|
| 12405 | 6/1972 | Japan . |
| 21773 | 2/1981 | Japan . |
| 45372 | 4/1981 | Japan . |
| 93801 | 7/1981 | Japan . |
| 57-145985 | 9/1982 | Japan . |
| 1041620 | 9/1966 | United Kingdom . |

*Primary Examiner*—Shrive P. Beck

*Attorney, Agent, or Firm*—Webb, Burden, Robinson & Webb

[57] ABSTRACT

A blast material for the mechanical plating and a continuous mechanical plating process. The blast material comprises up to 90% by weight of steel shot not less than 10% by weight of an alloy powder which comprises 2.5–50% by weight of iron, not more than 5% by weight of at least one of aluminum, copper, tin, magnesium and silicon, the balance being zinc, and has a maximum particle size of about 0.4 mm and an average hardness of 140–450 Hv., The continuous mechanical process comprises continuing blasting, recycling the used blast material and magnetically separating the abraded fine particles of the steel shot in the course of the recycling.

4 Claims, 4 Drawing Figures

BLAST MATERIAL FOR MECHANICAL PLATING AND CONTINUOUS MECHANICAL PLATING USING THE SAME

CROSS REFERENCE TO RELATED APPLICATION

This application is division of application Ser. No. 753,879, filed July 11, 1985, now U.S. Pat. No. 4,655,8342.

FIELD OF THE INVENTION

This invention relates to a blast material for mechanical plating which is used for forming a coating having excellent adhesivity and corrosion resistance on the surface of metallic materials and a continuous mechanical plating process using the same.

BACKGROUND OF THE INVENTION

Various processes have heretofore been proposed for mechanical plating techniques which employ blasting to form a protective coating on the surface of metallic materials, especially iron materials.

For instance, British Pat. No. 1,041,620 discloses a process for forming a corrosion-resistant coating by blasting a mixture of grit and particles of a coating metal onto the surface to be treated. Zinc powder is given as an example of the coating metal particles, and this patent teaches that the zinc powder should preferably be of high quality containing not more than 0.2% by weight of lead, arsenic, etc, and that steel shot which is harder than the coating metal particles, especially steel shot having a particle diameter of 0.4–0.8 mm, is preferred as grit. However, although a zinc coating film is formed by the process of this British Patent, the coating amount of the formed zinc film is limited and the corrosion resistance thereof is also limited as illustrated hereinafter by Comparative Examples A and B. It is thought that this is because the zinc particles are soft and smooth and therefore they are easily flattened between the shot material and the surface being treated. This flattening absorbs the energy of projection, and increases the collision contact area between the surface being treated and the zinc particles, making exposure of active surface difficult and thus decreasing adhesion.

Japanese Laid-Open Patent Publication No. 12405/72 discloses a mechanical plating material comprising shot material on the surface of which a coating metal (zinc) powder is bonded with an organic binder. This material differs from that of said British Patent in that an organic binder is used. But the film thus formed is limited in coating amount and corrosion resistance because of the smooth surface and the low hardness of zinc, since high purity zinc is used.

Thus the processes of said British Patent No. 1,041,620 and Japanese Laid-Open Patent Publication No. 12405/72 practically did not achieve commercial success.

Japanese Laid-Open Patent Publication No. 21773/81 and Japanese Patent Publication No. 9312/84, the applicants of which are the same as the assignee of the present invention, disclose shot materials which comprise iron cores around which iron-zinc alloy (intermetallic compound) crust is integrally formed with the cores. When these blast materials are used, the iron-zinc alloy, which is very hard and brittle, is broken by brittle fracture and by the percussion energy of the heavy iron cores and the broken particles hit the surface being treated with a small collision contact area, and thus a tightly-bonded film (iron-zinc alloy film) with very good corrosion-resistance is formed with a high coating weight. Therefore, these materials are now being spotlighted as promising commercial mechanical plating materials. However, a problem with these materials is how to carry out the mechanical plating continuously with the materials without time course change, replenishing the consumed iron-zinc layer. With respect to this problem, Japanese Laid-Open Patent Publication No. 9312/84 suggests that the initially-used blast material is supplied as the operation continues. In this case, the particles which have been abraded during the operation inevitably remain in the blast material system.

Japanese Laid-Open Patent Publication No. 93801/81 discloses a zinc alloy powder for mechanical plating, which comprises zinc to which small amounts of various metals are alloyed. This coating metal powder does not contain iron as an alloying element.

Japanese Patent Publication No. 25032/84 discloses a mechanical plating method for forming corrosion-resistant film by adjusting the particle size of the shot material and that of the coating material. This publication does not teach use of iron-zinc alloy.

The present invention provides a novel and useful blast material for mechanical plating and a continuous mechanical plating process which are different from the conventional mechanical plating techniques.

DISCLOSURE OF THE INVENTION

This invention provides a blast material for mechanical plating comprising: a steel shot material having a particle size of not smaller than 0.25 mm, preferably at least 70% of which has a particle size less than 0.4 mm, and an iron-zinc alloy coating powder having a particle size not substantially larger than 0.4 mm, preferably at least 80% of which has a particle size not larger than 0.25 mm, said alloy powder containing 2.5–50% preferably 5–40%, more preferably 10–40% by weight of Fe and not more than 5% by weight in all of at least one of Al, Cu, Sn, Mg and Si, the balance being Zn and inevitable incidental impurities, and has an average hardness of 140–450 Hv, and the mixing ratio of the alloy powder to the steel shot is at least 10%:90% by weight and preferably 25–40%:75–60% by weight; and more preferably 30–40%:70–60% by weight.

This invention further provides a continuous mechanical plating process using said blast material comprising repeatedly projecting the projected blast material onto the surface being treated, said blast material comprising; 60–90% by weight of steel shot having a minimum particle size of about 0.25 mm, preferably at least 70% by weight of which has a particle size less than 0.4 mm, and 10–40% by weight of an iron-zinc alloy powder for coating having an average hardness of 140–450 Hv comprising 2.5–50% by weight of Fe and not more than 5% in total of at least one of Al, Cu, Sn, Mg and Si, said powder having a maximum particle size of about 0.4 mm, preferably 80% by weight of which has a particle size less than 0.25 mm, wherein a magnetic separation step is interposed in the course of the repetition of blasting of the blast material, whereby fine iron particles produced by the blasting are separated and eliminated from the blast material system.

BRIEF EXPLANATION OF THE ATTACHED DRAWING

SPECIFIC DESCRIPTION OF THE INVENTION

Figure 1:
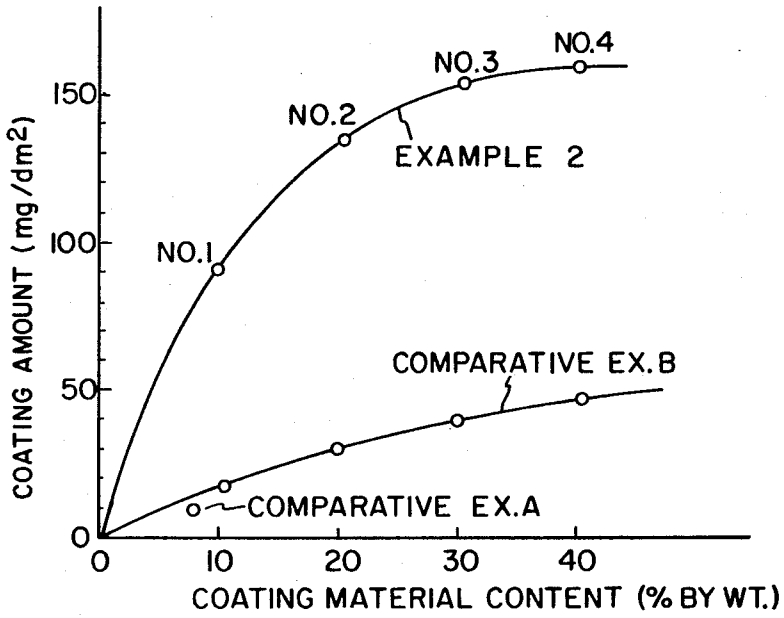
FIG. 1 is a diagram showing the relation between the mixing ratio of the coating material and the shot material and coating amount.

The invention will now be explained in detail.

The blast material for mechanical plating (simply referred to as "blast material" hereinafter) is a mixture of steel shot (simply referred to as "shot material" hereinafter) having a particle size distribution and an iron-zinc alloy coating powder (simply) referred to as "alloy powder" or "coating material" hereinafter).

As specifically described later in the working examples, compared with the conventional blast material especially those using zinc as the coating material, the blast material of this invention has higher adhesivity to the surface to be treated, is able to form a homogeneous strong coating film with higher coating amount even on an irregular surface such as a bolt, for instance, and is able to provide excellent corrosion resistance. In order to achieve such effect, the blast material must satisfy the conditions specified below.

The alloy powder is an iron-zinc alloy comprising 2.5–50% Fe and not more than 5% by weight in total of at least one of Al, Cu, Sn, Mg and Si, the balance being zinc and inevitable incidental impurities, said alloy powder having an average hardness of 140–450 Hv. The particle size of this alloy powder is preferably not larger than 0.4 mm and 80% by weight of the total powder is less than 0.25 mm. Use of such an alloy powder in combination with a shot material has not previously been known. The invention of Japanese Patent Publication No. 9312/84 is different from the alloy powder of the present invention which is used together with a shot material in that said blast material comprises shot material particles per se around which iron-zinc alloy is formed integrally.

The alloy powder in accordance with this invention contains 2.5–50% by weight of Fe since such composition gives an alloy powder having high hardness and being liable to brittle fracture. An alloy powder containing less than 2.5% Fe does not exhibit the desired hardness, and the mechanical plating in accordance with the afore-mentioned principle cannot be effected therewith. An alloy powder containing more than 50% Fe hardly forms a coating film having effective corrosion resistance. It is not necessary that every particle of the alloy powder has the same Fe content; each particle can have a different amount of Fe. The iron content 2.5–50% by weight referred to here means that each particle may contain Fe in this range, and the iron content of the powder as the whole is 5–40% by weight on average, preferably 10–40% by weight, more preferably 15–35% by weight on average.

At least one of Al, Cu, Sn, Mg and Si is added in an amount of not more than 5% by weight in total, since a desired hardness of the alloy powder can be maintained even if up to 5% by weight of these elements is added and these elements improve corrosion resistance and enhance hardness and brittleness. The preferred alloying element is Al. Addition of Al only gives satisfactory results, but when it is used in combination with a small amount of Cu, the best results are obtained.

Hardness and particle size of the alloy powder have important significance. First of all, the alloy powder must have a hardness in a range of 140–450 Hv. The alloy powder having a hardness in this range and the above-mentioned composition is able to undergo brittle fracture which exposes fresh surface and to become subparticles having microscopically acute-angular points, which can form a strong coating film by collision with the surface being treated with smaller contact area (with a greater repulsion coefficient). It is preferred that the alloy powder has a particle size not greater than 0.4 mm and a particle size distribution such that not less than 80% by weight of the total particles having a particle size not substantially larger than 0.25 mm. The alloy powder of this invention having high hardness as described above forms a strong coating film by undergoing brittle fracture caused by the energy of projection. The smaller the particle size, the larger the area of the fresh active surface exposed by brittle fracture, and the more the adhesion strength. In the case of continuous operation, if particles larger than 0.4 mm are initially contained, they become smaller by brittle fracture, and therefore it is not always necessary to start with particles not larger than 0.4 mm.

The alloy powder having such hardness and particle size distribution is prepared preferably by adding iron powder to a melt of zinc (containing not more than 5% by weight in total of at least one of Al, Cu, Sn, Mg and Si) and letting the melt solidify under proper control of temperature and reaction time and mechanically pulverizing the solidified alloy utilizing the brittleness of the iron-zinc alloy. In this case, if the reaction conditions are controlled so that unreacted iron particles (or iron-rich cores) are distributed in the solidified alloy and an iron-zinc alloy layer (intermetallic compound) is formed around the iron cores with some concentration grade, there is a tendency that larger iron-rich particles and smaller particles with less iron content are formed by mechanical pulverization. Thus, iron-zinc alloy powder (other than iron-cored powder) of a desired composition can be obtained by properly screening the thus obtained powder, that is, collecting a desired fraction, and the iron content thereof can be optionally controlled.

The shot material which is used with the alloy powder can theoretically be any material if it is able to provide projection energy. However, when the material the surface of which is to be treated is iron or an iron alloy, steel shot is preferably used in order to avoid possible inclusion of foreign materials in the formed coating film upon mechanical plating. The steel shot preferably has a particle size of at least about 0.25 mm, of which at least 70% by weight is less than about 0.4 mm. This particle size is smaller than that of ordinary blast materials. In the blast material of this invention, an unprecedented alloy powder as hard as 140–450 Hv is used, which has not been used previously, and the mode of film forming is different from that of the conventional blast materials. It is because of this that blasting can be effectively carried out with such fine steel shot.

Figure 2:
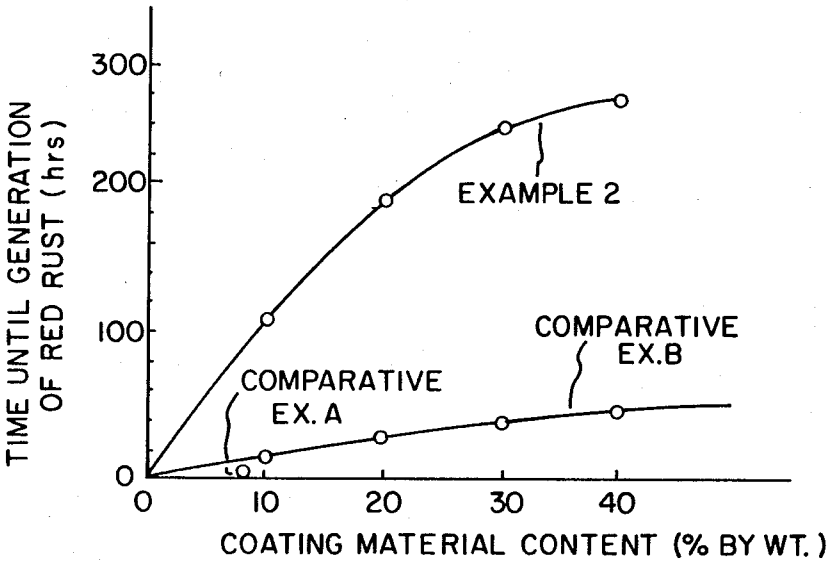
FIG. 2 is a diagram showing the relation between the mixing ratio of the coating material and the shot material and red rust generation time of coated articles.

The alloy powder is mixed with the steel shot in a proportion of not less than 10% by weight based on the total amount of the blast material, preferably in a proportion of 60–75% by weight of steel shot and 25–40% by weight of the alloy powder. The relation between the proportion and the resulting coating amount is shown in FIG. 1 and FIG. 2. With a proportion of the alloy of not less than 10% by weight, corrosion-resistant films with the highest coating weight ever known and corrosion resistance in excess of the conventional limit can be formed. The test conditions on the data shown in FIG. 1 and FIG. 2 are explained in detail in the working examples described hereinafter.

When the blast material of this invention comprising the above-described alloy powder and steel shot is used for mechanical plating, an excellent coating film with high coating amount and superior corrosion resistance as shown in FIG. 1 and FIG. 2 and homogeneous coating film with high adhesivity as illustrated in the working examples described below is obtained. The reason is not quite clear, but it is considered as follows Adhesion between metals in the mechanical plating is caused by Van der Waals force and it depends upon the intensity and frequency of collisions. And it is important for formation of strongly adherent films that the energy of collision is effectively converted to adhesive force, and the surface of particles which adhere is active (free from oxide film, etc.) all the time. The alloy powder in accordance with this invention is hard and brittle per se and is able to form a coating film by itself (without shot material) when projected with some projection energy. When projected together with shot material, the shot material collides with the film and enhances the adhesion thereof. By the projection of the alloy powder and of the shot material, fresh surface of the alloy powder is always exposed and the brittle fracture occurs and active surfaces adhere by virtue of Van der Waals force. The occurrence of brittle fracture means that the surface to be treated and the alloy powder always collide with smaller contact area. This also means that projection energy is converted into adhesive force as is.

This phenomenon will be more clearly understood when compared with the phenomenon which occurs when less hard zinc powder or particles are projected with shot material. That is, zinc particles, which have a smooth surface and are softer and malleable, adhere to the surface being treated in a flattened, microscopically scale-like form. Unlike the alloy powder of this invention, they do not adhere to the surface to be treated repeating brittle fracture; instead, the projection energy is consumed for this flattening to some extent, and is not directly converted into adhesive force since the contact surface is larger. Therefore, the resulting adhesive force is rather weak. Also constant exposure of fresh surface hardly occurs, and therefore, oxide film on the particle surface remains as is between the particles which have adhered in the form of a film, which weakens adhesivity. Such a coating film which adheres with weak adhesive force is liable to peel off, when projection is repeated if the coating film exceeds a threshold thickness. Therefore, there is a limit in the coating amount as illustrated in the comparative examples described below, and a coating in excess of the thickness limit cannot be formed even if blasting is repeated.

The alloy powder in accordance with this invention is remarkably different from conventional coating materials for mechanical plating in that the powder comprises hard particles having an acute-angular shape and being liable to brittle fracture and converts projection energy directly to adhesive force and does not cause buffering of projection energy as in the case of zinc powder. This alloy powder enables formation of a corrosion-resistant film on the surface to be treated (especially on the surface of iron or iron alloys) excellent in coating amount, adhesion strength, homogenity in thickness, etc. which could be effected by a mechanical plating method. This is markedly effective for pre-treatment for painting, etc.

Now a preferable continuous mechanical plating process in which the blast material of this invention is used is described.

It is preferred to use a blast material repeatedly and it is also preferred that a blast material be continuously projected onto the surface to be treated. In such a continuous treatment, it is desired that the blast material retains constant film-forming ability throughout the course of the continuous processing and the formed film per se remains constant. However, the alloy powder of this invention is further pulverized as well as consumed and the steel shot is abraded in the course of mechanical plating. A very important subject is how to control the time course change in quality and quantity of the blast material in order to enable the process to be continuous.

We studied how to overcome this problem, and we have found that it is very effective to interpose a magnetic separation step in the course of repeated projection of the blast material in order to remove the fine iron particles which have been produced during blasting when the blast material of this invention is projected onto the surface being treated and the projected blast material is recycled and repeatedly projected. That is, a step of separating the formed fine iron powder which depends upon the difference in magnetism is interposed in the course of repeated projection of the blast material.

Figure 4:
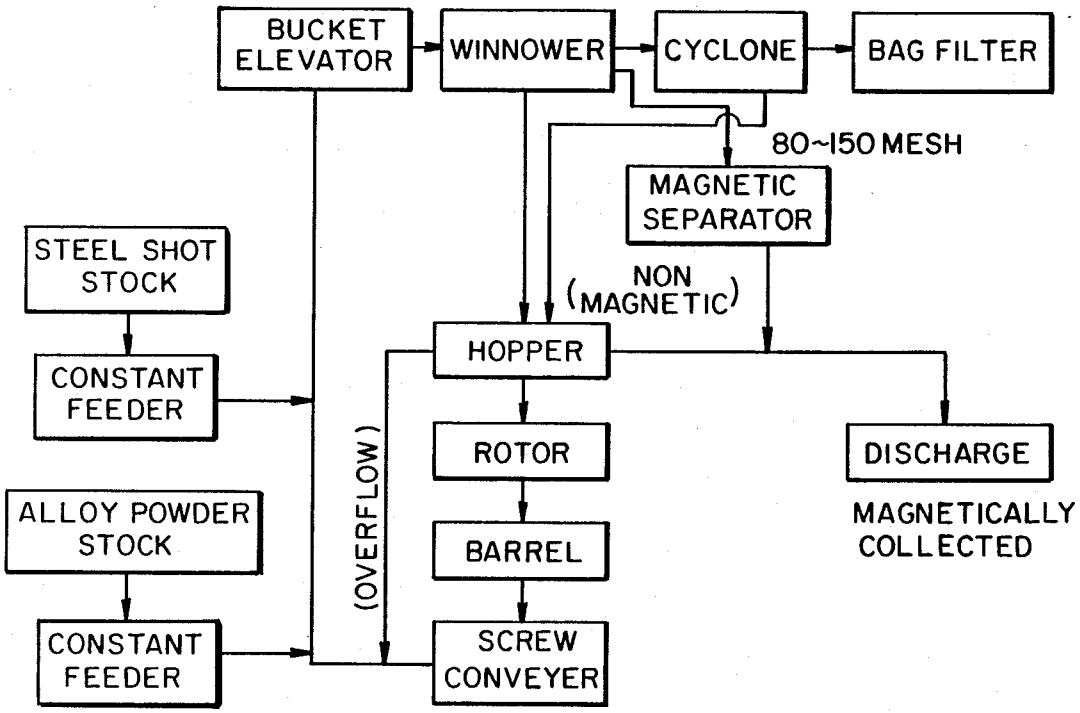
FIG. 4 is a flow diagram showing an example of continuous blasting operation in accordance with this invention.

FIG. 4 is a flow diagram of steps of a working example (details of which are described later) in which a barrel type blasting machine is used. In this embodiment, a primary separation (winnowing) step and a magnetic separation step with a magnetic separator are interposed in the stage where the blast material which has been used and is taken out of the barrel is returned to the hopper of the same blasting machine.

This magnetic separator is primarily intended to separate abraded steel shot and take it out of the system. Abraded steel shot may be involved in the formed coating film and also will change projection performance. When the used blast material is subjected to a primary separation, to separate it into a larger particle portion and a smaller particle portion, the alloy of this invention and the abraded steel shot come into the smaller particle portion (of 80–150 mesh, for instance), and the abraded steel shot can be separated therefrom by magnetic separation. That is, the alloy particles in the smaller particle portion go into the non-magnetic fraction and the abraded steel shot is collected by the magnet and thus the latter can be taken out of the system. The non-magnetic portion is recycled.

In this case, if the amount of the steel shot taken out of the system and the amount of the alloy powder consumed for coating film formation change the proper composition of the blast material system beyond a tolerance limit, the system must be replenished with the alloy powder and steel shot. The replenishment can be effected by means of constant feeders as indicated in FIG. 4.

The fact that only the abraded steel shot can be selectively taken out of the system by insertion of a magnetic separation step greatly contributes to the merit of the continuous mechanical plating process by which a coating excellent in corrosion resistance can be formed. Because fine steel particles which might be involved in the formed coating film may cause degradation of corrosion resistance by oxidation of themselves. In the blasting in accordance with this invention, the involvement of steel shot per se in the coating cannot practically occur when the steel shot is not greatly abraded.

Not only in a continuous process but also in a batch process, the application of magnetic separation will enable the semipermanent recycled use of the blast material in accordance with the present invention.

The blast material in accordance with this invention is effectively used for the mechanical plating process to form an excellent coating whether it is a continuous process or a batch process, as explained above. But this blast material can also be used in blasting employed for derusting, surface cleaning, etc. This material can most suitably be applied in the case wherein formation of an excellent corrosion resistant film is desired simultaneously with derusting.

DESCRIPTION OF WORKING EXAMPLES

Now the invention will be specifically described by way of working examples.

EXAMPLE 1

(Preparation of Alloy)

Iron particles about 50% of which are +16 mesh were pulverized by an impact type crusher and iron powder under 16 mesh was obtained by removing coarse particles. This iron powder was placed in a cylindrical container of silicon carbide and sintered in a tunnel furnace at 920° C. for 6 hours. The resulting sinter was crushed by an impact type crusher and fractions of 16–32 mesh (1 mn–500 μm), 32–48 mesh (500–297 μm), 48–60 mesh (297–250 μm), 60–80 mesh (250–177 μm), 80–150 mesh (177–105 μm) and not larger 150 mesh (105 μm), fractions were separately collected and the fraction of 32–48 mesh (500–298 μm) used as iron stock.

A molten bath comprising 4% by weight of Al, 0.5% by weight of Cu, the balance practically comprising Zn was prepared and kept at 620°±5.0° C. The iron powder fraction of 32–48 mesh (500–298 μm) was added to the molten bath in an amount of 50% by weight and was allowed to react at a temperature in the range of 500°–600° C. for reaction times in the range of 3 to 10 minutes. Thereafter each of the molten metals was released into the atmosphere and the resulting metals were kept at 200°–300° C. The metal was crushed at this temperature utilizing brittleness and further pulverized by means of a hammer crusher. The resulting powders were screened with a 48 mesh screen and the fraction not larger than 48 mesh (500 μm) was collected.

The resulting alloy powders were tested for hardness (micro-Vickers) and overall iron content according to reaction conditions. The results are summarized in Table 1 .

TABLE 1

| Reaction Conditions | | Hardness | Overall Content of Fe |
|---|---|---|---|
| Temp. | Time | (micro-Vickers) | (% by weight) |
| 520 ± 5° C. | 3 min. | 170 | 10.4 |
| 530 ± 5° C. | 5 min. | 220 | 15.3 |
| 590 ± 5° C. | 5 min. | 350 | 20.1 |
| 590 ± 5° C. | 10 min. | 420 | 35.5 |

It is learned from the results shown in Table 1 that even if the same Zn melt and iron source are used, alloy powders with varied hardness and Fe content can be obtained by adjustment of reaction conditions. The amount of the formed zinc-iron intermetallic compound varies according to reaction conditions and the intermetallic compound is concentrated in smaller particles when the alloy powder is divided at a particle size (at 48 mesh in this example). When the reaction is allowed to proceed longer at higher temperatures and for longer reaction times, more zinc-iron intermetallic compound is concentrated in smaller particles and thus smaller and harder (that is, iron-rich) particles are obtained. This means the distribution of the added Al, Cu, etc. also varies between the smaller particle portion and the larger particle portion. According to this invention, harder and finer alloy powder can be advantageously obtained by utilizing this phenomenon.

EXAMPLE 2

(Blasting)

Of the alloy powders prepared in Example 1, the alloy powder having a hardness of 350 Hv and an iron content of 20.1% by weight was used for blasting. The precise composition of this alloy powder was Fe: 20.1%, Al: 2.1%, Cu: 0.3%, the balance being Zn. The average hardness of particles was 350 Hv. Of the powder not larger than 48 mesh, about 80% by weight was not larger than 60 mesh.

Steel shot was mixed with the above alloy powder in the proportions indicated in Table 2 to make blast materials. The steel shot had a hardness of 450 Hv and the particle size was not smaller than 60 mesh and not larger than 32 mesh.

TABLE 2

| | Mixing Ratio (% by weight) | |
|---|---|---|
| Test Run No. | Alloy Powder | Steel Shot |
| 1 | 10 | 90 |
| 2 | 20 | 80 |
| 3 | 30 | 70 |
| 4 | 40 | 60 |

Each blast material was blasted onto test pieces of S45C hot-rolled steel sheet using a tumbler type blasting machine. Projection rate was 70 kg/min. and projection velocity was 51 m/sec (peripheral velocity) and projection time was 20 min. Each S45C hot-rolled steel sheet test piece was 1.2 mm×80 mm×150 mm in size. The test pieces had been descaled by a separate shot blasting.

After blasting with each blast material were finished some of the test pieces were soaked in a 25% by weight solution of caustic soda at 80°±2° C. to completely dissolve the zinc film formed on the surface of the test pieces. The amounts of dissolved zinc were calculated as the coating amounts. The results are shown in FIG. 1. According to this invention, coating amounts more than 150 mg/dm$^2$ were attained.

Other of the test pieces were immersed in a 5% sodium chloride solution after blasting with each blasting material for testing rust generation. The results are shown in FIG. 2. The corrosion resistance of the test pieces treated in accordance with this invention is excellent, the time required for the generation of red rust reaching 270 hours.

COMPARATIVE EXAMPLE A

The procedure of Example 2 was repeated with a blast material consisting of steel shot and zinc powder. The particle size of the used zinc powder (a commercially available product) was 6 μm on average, and the mixing ratio to the steel shot was 8% by weight.

The coating amount was measured and the rust generation test was carried out in the same way as in Example 2. The results are indicated in FIG. 1 and FIG. 2.

COMPARATIVE EXAMPLE B

The procedure of Example 2 was repeated with a blast material consisting of steel shot and zinc powder. The zinc powder had been prepared by the atomizing process and was 99.5% or higher in purity, 70 Hv or higher in hardness and not larger than 150 mesh in particle size, or which 10% was not larger than 350 mesh. The zinc mixing ratio was varied in the same way as in Example 2.

The measurement of coating amount and the rust generation test were carried out in the same way as in Example 2. The results are indicated in FIG. 1 and FIG. 2.

From the results shown in FIG. 1, it is apparent that the blast material of this invention brings about markedly greater coating amount compared with those of Comparative Examples A and B. An especially greater coating amount is achieved by using a blast material in which the ratio of the alloy powder to steel shot is not lower than about 25% by weight. However, if this ratio is in excess of 40%, the attained projection energy is relatively low and thus a larger coating amount cannot be expected. In Comparative Examples A and B in which zinc powder is mixed with steel shot, there is a limit to the coating amount. With the blast material in which the alloy powder of this invention is used, this limit is largely exceeded. The reason therefor is thought to be stated above. That is, because of the high hardness and brittleness of the alloy powder of this invention, minute local fractures (brittle fracture) repeatedly occurs upon collision and small contact area is maintained between the colliding particles and the surface to be treated, so fresh active surface is exposed all the time, effectively bringing about the good results.

Also it is apparent from the results shown in FIG. 2 that the coating film formed with the blast material of this invention has excellent corrosion resistance. It means that the coating formed with the blasting material of this invention adheres to the substrate surface closely and integrally with no interstices in the interface between the coating film and the substrate and the strength of adhesion therebetween is high. In the case of Comparative Example B, corrosion resistance of the resulting film is slightly increased by increase of the mixing ratio of zinc powder. However, there is a limit thereto. In contrast, in the case of this invention, corrosion resistance far exceeding this is achieved with smaller alloy content and better corrosion resistance can be effected with increased alloy content. However, an alloy content up to 40% will be preferred from the relation shown in FIG. 1.

EXAMPLE 3

(Pre-Treatment for Painting)

As test pieces, 0.8 mm×70 mm×150 mm cold-rolled steel sheets were used, and blasting was effected with the same blast material as No.3 in Table 2 in Example 2. The coating amount was 100 mg/dm$^2$.

The thus obtained coated test pieces were painted with the various paint materials indicated in Table 3 and were baked for 20 minutes at the respective baking temperatures indicated in the table. Thus a 25–40 μm thick coating was formed upon the alloy coating film of each test piece.

TABLE 3

| Type of Coating Material | Trade Name | Baking Temp. (°C.) |
|---|---|---|
| Acrylic | Belcoat #1500* | 130 |
| Epoxy | Hi-Epico #1500* | 160 |
| Polyester A | Porion #2000* | 180 |
| Polyester B | Porion #1000* | 150 |

*Manufactured by Nippon Oil and Fat Co., Ltd.

The obtained coated test pieces were subjected to the cross cut adhesion test and the salt spray test (with cross cut) as stipulated in JIS (Japanese Industrial Standards). The results are shown in Table 4 and Table 5.

As a comparative example, the same coating materials as indicated in Table 3 were applied to steel sheets which had been treated with the conventional chemical conversion composition ("Bondy" of Nippon Parkerizing Co., Ltd.). The thus obtained samples were subjected to the cross cut adhesion test and salt spray test. The results are summarized in Table 4 and Table 5.

TABLE 4

(Cross Cut Adhesion Test, JIS)

| Type of Paint Material | Working Example | Comparative Example |
|---|---|---|
| Acrylic | 100/100 | 100/100 |
| Epoxy | 99/100 | 99/100 |
| Polyester A | 100/100 | 100/100 |
| Polyester B | 100/100 | 100/100 |

TABLE 5

(Salt Spray Test, JIS)

| Type of Paint Material | Treatment of Substrate | Salt Spray Time (hrs) 324 | 168 | 360 | 500 |
|---|---|---|---|---|---|
| Acrylic | Invention | 5 | 4.8 | 2.5 | 1.5 |
| | Conventional | 3.5 | 1.5 | — | — |
| Epoxy | Invention | 5 | 2.0 | 1.0 | 1.0 |
| | Conventional | 2.5 | 1.0 | — | — |
| Polyester A | Invention | 5 | 5 | 4.8 | 3.5 |
| | Conventional | 3 | 1.0 | — | — |
| Polyester B | Invention | 5 | 5 | 5 | 5 |
| | Conventional | 4 | 1 | — | — |

Note:
5 - No rust generated; 3 - Red rust spots generated; 1 - Red rust generated all over the surface As seen in Table 4, the test pieces which comprise the steel sheets which were coated in accordance with this invention and painted exhibited the same level of paint adhesion as the test pieces comprising steel sheets treated with the conventional chemical conversion process. That is, the substrate obtained by mechanical plating with the alloy powder of this invention exhibited paint adhesion of the same level as the substrate treated with said "Bondy". This substantiates the fact that the coating film of the alloy powder of this invention adheres very strongly to the surface to be treated.

The results shown in Table 5 indicate that the coating of the alloy powder of this invention has a remarkable effect to improve corrosion resistance as a treatment of the substrate for painting. Substrates treated in accordance with this invention are especially effective with polyester type paints. In the test pieces treated with said "Bondy", red rust was generated all over the surface in about 150 hours, while those coated in accordance with this invention were quite free of rust after 500 hours. The test pieces with acrylic and epoxy type paints also exhibited remarkably better results results in comparison with the test pieces treated by the conventional chemical conversion process.

EXAMPLE 4

(Continuous Blasting)

A blast material was prepared by mixing in a ratio of 35:65 by weight the alloy powder having a hardness of 350 Hv, a Fe content of 20.1% and a particle size of not larger than 48 mesh, and of which 80% was not larger than 60 mesh which had been prepared in Example 1, and steel shot of which the particle size distribution was not larger than 32 mesh and not smaller than 60 mesh.

Figure 3:
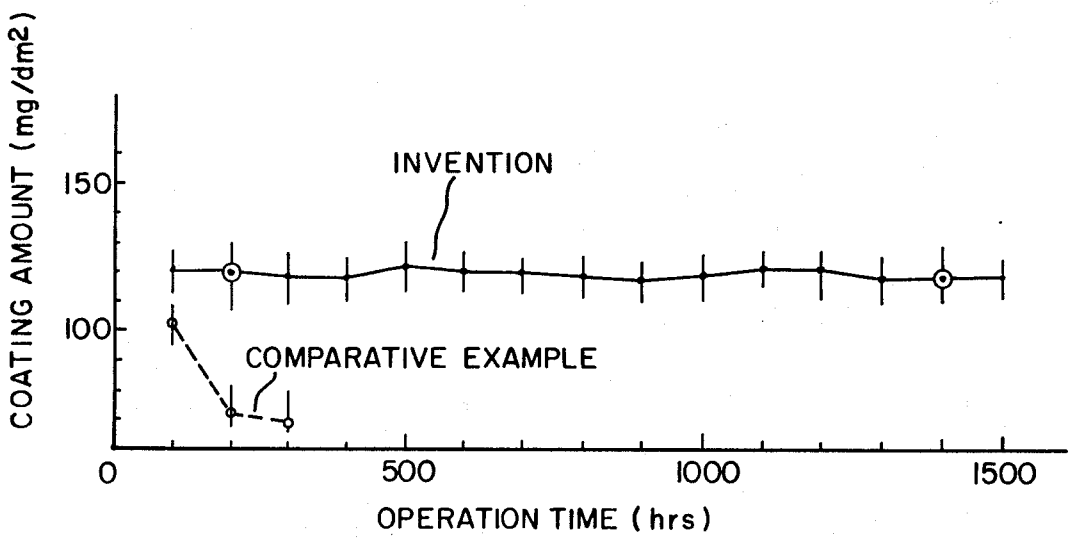
FIG. 3 is a diagram showing the relation between the operation time and the coating amount in the continuous blasting operation in accordance with this invention.

M20 bolts and 80 kg of iron pieces of 3 mm×50 mm×150 mm were placed in a tumber type blasting machine of 100 kg capacity. The abovementioned blast material was projected at a rate of 70 kg/min. with a projection velocity of 51 m/sec. Blasting was continued for 1500 minutes in total. During this continuous operation, in order to measure coating amounts, five iron test pieces of 1.2 mm×30 mm×50 mm were introduced in the blasting machine every 100 minutes; and twenty (20) minutes after the introduction, these test pieces were retrieved for analysis. This was repeated 15 times. The results of the analysis are illustrated in FIG. 3.

This continuous operation was conducted in a cycle as follows in order to take out steel shot which has been abraded or become fine powder and to replenish the consumed alloy powder.

The used blast material taken out of the rotor of the blasting machine is treated as shown in FIG. 4. That is, the blast material is sent to a primary separator (winnowing apparatus) through the barrel, a screw conveyer and a bucket elevator. The particles larger than 80 mesh separated by the primary separator were recycled to the hopper while particles of 80–150 mesh were sent to a magnetic separator, wherein they were separated into a magnetic fraction collected by the magnet and a non-magnetic fraction. The non-magnetic fraction is the alloy powder and the magnetic fraction is abraded steel shot. The non-magnetic fraction is sent to the hopper and the magnetic fraction was taken out of the system. The particles smaller than 150 mesh which were separated by the primary separator (winnower) were further separated in a cyclone and the portion collected at the bottom was returned to the hopper and the portion let out from the top was collected by a bag-filter and was taken out of the system.

It had been known from a preliminary experiment that consumption of the alloy powder per one cycling through the blasting machine was about 1/3000 by weight and that of the steel shot was 1/5000 by weight. Alloy powder and steel shot in the amount corresponding to said consumption and the amount of the fine powder which was taken out of the system were added constantly to the flow from the screw conveyer to the bucket elevator by means of constant feeders respectively. The alloy powder and steel shot were the same materials as were initially introduced.

The results shown in FIG. 3 indicate that formation of the coating was maintained constant without time course change throughout the continuous operation of 1500 minutes. In FIG. 3, the result of an operation run in which blasting was continued for 300 minutes without recycling and replenishment of the blast material is also indicated as a comparative example. In this case, the coating amount steeply decreased with the elapse of time.

Further, samples were taken after 200 minutes and 1400 minutes in the operation run according to this invention and corrosion resistance thereof was determined to compare their corrosion resistances. It was revealed that there was no significant difference between the two groups of samples. This means that the continuous operation in accordance with this invention can effectively prevent involvement of fine iron particles produced by abrasion or crushing in the coating, which may impair the corrosion resistance of the resulting film.

EXAMPLE 5

A molten bath comprising 1.0% by weight of Mg and 0.3% by weight of Si, the balance practically comprising Zn was prepared and kept at 620°±5° C. The iron powder fraction of 500 μm–297 μm was added to the thus prepared bath and was allowed to react at 590°±5° C. for reaction time of 5 minutes. Thereafter the molten metal was released into the atmosphere and the resulting alloy was kept at 300°–200° C. The alloy was crushed utilizing the brittleness and was further pulverized by means of a hammer crusher. The resulting powder was screened with 297 μm screen and the fraction not larger than 297 μm was collected. The average hardness of the thus obtained alloy powder was 350 Hv. About 80% by weight of the alloy powder was not larger than 250 μm. The alloy powder obtained in the above was mixed with a steel shot material, the particle size distribution was 500 μm–250 μm, in a mixing ratio or 30:70 by weight to make a blast material.

The blast material was projected onto test pieces of S45C cold rolled sheet using a tumbler type blast machine. Projection rate was 70 kg/min, the projection velocity was 51 m/sec and projection time was 20 min.

The thus obtained mechanically plated test pieces were tested in the same way as in Example 2. The results were as follows.

Coating amount: 165 mg/dm$^2$.

Time required for generation of red rust: 220 hours.

In the case of addition of Mg and Si, the hardness of the shot material slightly lower, but the coating amount is larger, and the corrosion resistance of the formed coating is slightly inferior compared with the case of addition of Al and Cu.

Sole addition of Al brings about results as good as in the case of addition of Al and Cu, although crushing of the alloy is less easy. Sole addition of Cu, Sn, Mg or Si also brings about better results than when just zinc is used.

We claim:

1. A continuous mechanical plating process comprising projecting a blast material consisting of a mixture of 60–970% by weight of steel shot and 10–40% by weight of a coating alloy powder comprising 2.5–50% by weight of Fe and a maximum of 5% by weight of at least one of Al, Cu, Sn, Mg and Si, the balance being Zn and inevitable impurities, said coating alloy powder having an average hardness of 140–450 Hv, onto the surface to be treated, and projecting said blast material repeatedly, characterized in that a magnetic separation step is interposed in the course of repetition of the projecting, whereby fine iron powder produced during blasting is removed from said mixture.

2. The continuous mechanical plating process as set forth in claim 1, wherein said steel shot material has a minimum size of about 0.25 mm, and at least 70% by weight of said shot material has a maximum size of about 0.4 mm.

3. A continuous mechanical plating process as set forth in claim 1 wherein said alloy powder has a maximum particle size of about 0.4 mm and at least 80% by weight of said powder has a particle size less than about 0.25 mm.

4. A continuous mechanical plating process is set forth in claim 2 wherein said alloy powder has a maximum particle size of about 0.4 mm and at least 80% by weight of said powder has a particle size less than about 0.25 mm.

* * * * *